US006170445B1

(12) United States Patent
Hattori et al.

(10) Patent No.: US 6,170,445 B1
(45) Date of Patent: Jan. 9, 2001

(54) ELECTROMAGNETIC ACTUATING SYSTEM OF INTERNAL COMBUSTION ENGINE

(75) Inventors: Hiroyuki Hattori; Takashi Izuo; Tatsuo Iida; Masahiko Asano, all of Toyota (JP)

(73) Assignee: Toyota Jidosha Kabushiki Kaisha, Toyota (JP)

( * ) Notice: Under 35 U.S.C. 154(b), the term of this patent shall be extended for 0 days.

(21) Appl. No.: 09/441,336

(22) Filed: Nov. 16, 1999

(30) Foreign Application Priority Data

Nov. 19, 1998 (JP) ..... 10-329931

(51) Int. Cl.[7] ..... F01L 9/04; F02D 13/02
(52) U.S. Cl. ..... 123/90.11
(58) Field of Search ..... 123/90.11; 251/129.01, 251/129.1, 129.15, 129.16

(56) References Cited

U.S. PATENT DOCUMENTS

| | | | | |
|---|---|---|---|---|
| 4,533,890 | | 8/1985 | Patel | 335/234 |
| 4,779,582 | | 10/1988 | Lequesne | 123/90.11 |
| 4,829,947 | | 5/1989 | Lequesne | 123/90.11 |
| 5,117,213 | * | 5/1992 | Kreuter et al. | 335/219 |
| 5,131,624 | * | 7/1992 | Kreuter et al. | 251/129.18 |

FOREIGN PATENT DOCUMENTS

| | | |
|---|---|---|
| 59-213913 | 12/1984 | (JP) . |
| 3-44010 | 2/1991 | (JP) . |
| 10-148110 | 6/1998 | (JP) . |

* cited by examiner

*Primary Examiner*—Weilun Lo
(74) *Attorney, Agent, or Firm*—Kenyon & Kenyon

(57) ABSTRACT

An electromagnetic actuating system of an internal combustion engine is provided. The system can hold an armature in a fully closed position or a fully opened position when the engine is started while obviating a necessity of the initial actuation and effectively reducing power consumption of the system. The system includes an engine valve which functions as an intake valve or an exhaust valve of the internal combustion engine, an armature which moves with the engine valve, an electromagnet which attracts the armature in a direction of movement of the engine valve by being supplied with a current and a spring which presses the armature away from the electromagnet. A permanent magnet, which can exert a magnetic attracting force between the armature and the electromagnet, is provided. The system further includes a stop-time current controller which shuts off the current supplied to the electromagnet, after controlling the current supplied to the electromagnet until the armature is attracted to the electromagnet by the magnetic attracting force of the permanent magnet, when a request to stop the internal combustion engine is generated.

12 Claims, 3 Drawing Sheets

OPERATION INSTRUCTING SIGNAL
ON
OFF
t 0

ATTRACTING CURRENT TO UPPER COIL
0
t 1
t 2

ENABLE SIGNAL
ON
OFF
t 3

POWER SUPPLY RELAY
ON
OFF
t 4
TIME

ELECTROMAGNETIC ACTUATING SYSTEM OF INTERNAL COMBUSTION ENGINE

BACKGROUND OF THE INVENTION

1. Field of the Invention

The present invention relates to an electromagnetic actuating system of an internal combustion engine, and particularly to an electromagnetic actuating system of an internal combustion engine which actuates an intake valve or an exhaust valve by cooperation of an electromagnetic force generated by an electromagnet and a resilient force generated by a spring.

2. Description of the Related Art

Conventionally, as disclosed in Japanese Laid-Open Patent Application No. 59-213913, there is known a solenoid valve having an engine valve which functions as an intake valve or an exhaust valve of an internal combustion engine. An armature is connected to the engine valve. Hereinafter, the engine valve and the armature are referred to as a movable part.

An upper electromagnet and an upper spring are disposed above the armature, and a lower electromagnet and a lower spring are disposed below the armature. The armature is held at a neutral position between the upper and lower electromagnets by the upper and lower springs. Each of the upper and lower electromagnets generates an electromagnet force which attracts the armature by being supplied with an exciting current.

According to the above-mentioned conventional solenoid valve, the movable part can be moved toward the upper electromagnet by supplying an exciting current to the upper electromagnet. Similarly, the movable part can be moved toward the lower electromagnet by supplying an exciting current to the lower electromagnet. Thus, according to the conventional solenoid valve, it is possible to actuate the intake valve or the exhaust valve to be closed and opened by alternately supplying exciting currents to the upper and lower electromagnets at appropriate timings.

In the conventional solenoid valve, when the movable part is in a fully closed position or a fully opened position, the movable part can promptly start being actuated in response to a request by cooperation of the electromagnetic force generated by the upper or lower electromagnet and a resilient force generated by the upper or lower spring. On the other hand, when power supply to the solenoid valve is shut off, the movable part is held at a neutral position between the fully closed position and the fully opened position since neither the upper electromagnet nor the lower electromagnet is energized. In this state, the armature is spaced away from both the upper and lower electromagnets and resilient forces of the upper and lower springs exerted on the armature are balanced. Thus, in order to start actuating the movable part from the neutral position, it is necessary to exert an electromagnetic attracting force on the armature spaced away from the electromagnets in a situation where the resilient forces of the springs cannot be used. Therefore, when the movable part is at the neutral position, electric power to be supplied to the electromagnet becomes large, and, additionally, it is difficult to promptly operate the solenoid valve.

For this reason, in the above-mentioned conventional solenoid valve, exciting currents are alternately supplied to the upper and lower electromagnets with a period corresponding to a natural vibration period of the movable part when the internal combustion engine is started. According to this technique, the movable part can be moved from the neutral position to the fully closed position or the fully opened position by a resonance phenomenon of the movable part. Hereinafter, the above-mentioned process of, when the engine is started, moving the movable part to the fully closed or opened position by exciting a natural vibration of the movable part is referred to as an initial actuation.

However, when the initial actuation is performed, a large operating sound is generated by a vibration of the movable part. Additionally, since exciting currents must be alternately supplied to the upper and lower electromagnets, power consumption of the solenoid valve becomes large.

In view of these disadvantages of the initial actuation, Japanese Laid-Open Patent Application No. 10-138110 discloses a solenoid valve which can maintain the movable part in the fully closed position without performing the initial actuation. This solenoid valve includes a solenoid which is provided to the upper spring at one end thereof opposite to the armature. When the solenoid is not energized, the upper spring is upwardly retracted. In this state, the armature is in contact with the upper electromagnet. On the other hand, when the solenoid is energized, the upper spring is downwardly pressed toward the armature by the solenoid. In this state, the armature is held in the neutral position. Thus, according to the above-mentioned structure, it is possible to hold the movable part in the fully closed position by simply de-energizing the solenoid.

However, when the engine is operating, the movable part must be actuated by the upper and lower electromagnets with the neutral position being a center of movement of the movable part. Thus, when the engine is operating, it is necessary to energize the solenoid so as to maintain a state where the upper spring is pressed toward the armature, resulting in increased power consumption of the solenoid valve.

SUMMARY OF THE INVENTION

It is an object of the present invention to provide an electromagnetic actuating system of an internal combustion engine which can hold an armature in a fully closed position or a fully opened position when the engine is started while obviating a necessity of the initial actuation and effectively reducing power consumption of the system.

The above-mentioned object of the present invention can be achieved by an electromagnetic actuating system of an internal combustion engine, comprising:

- an engine valve which functions as an intake valve or an exhaust valve of the internal combustion engine;
- an armature which moves with the engine valve;
- an electromagnet which attracts the armature in a direction of movement of the engine valve by being supplied with a current;
- a spring which presses the armature away from the electromagnet;
- a permanent magnet which can exert a magnetic attracting force between the armature and the electromagnet; and
- a stop-time current controller which shuts off the current supplied to the electromagnet, after controlling the current supplied to the electromagnet until the armature is attracted to the electromagnet by the magnetic attracting force of the permanent magnet, when a request to stop the internal combustion engine is generated.

In this invention, the controller shuts off a current to the electromagnet after the armature is attracted by the permanent magnet to the electromagnet. Since the permanent magnet can exert a magnetic attracting force between the armature and the electromagnet, the state in which the armature is attracted by the permanent magnet to the electromagnet can be maintained while the electromagnet is being de-energized, that is, while the internal combustion engine is not operating. A position of the armature in the state where the armature is attracted to the electromagnet corresponds to the fully closed position or the fully opened position. Thus, the armature can be held in the fully closed position or the fully opened position when the internal combustion engine is started next time without performing the initial actuation. Therefore, according to the invention, it is possible to prevent an increase in an operating sound and power consumption of the system due to execution of the initial actuation. Additionally, since it is unnecessary to supply a current to the electromagnetic coils so as to hold the armature, electric power is not consumed while the internal combustion engine is not operating. Further, since the magnetic attracting force of the permanent magnet contributes to a force for attracting the armature toward the electromagnet while the internal combustion engine is operating, a current to be supplied to the electromagnet can be reduced. Thus, power consumption of the system can be further saved.

Other objects and further features of the present invention will be apparent from the following detailed description when read in conjunction with the accompanying drawings.

DESCRIPTION OF THE PREFERRED EMBODIMENTS

Figure 1:
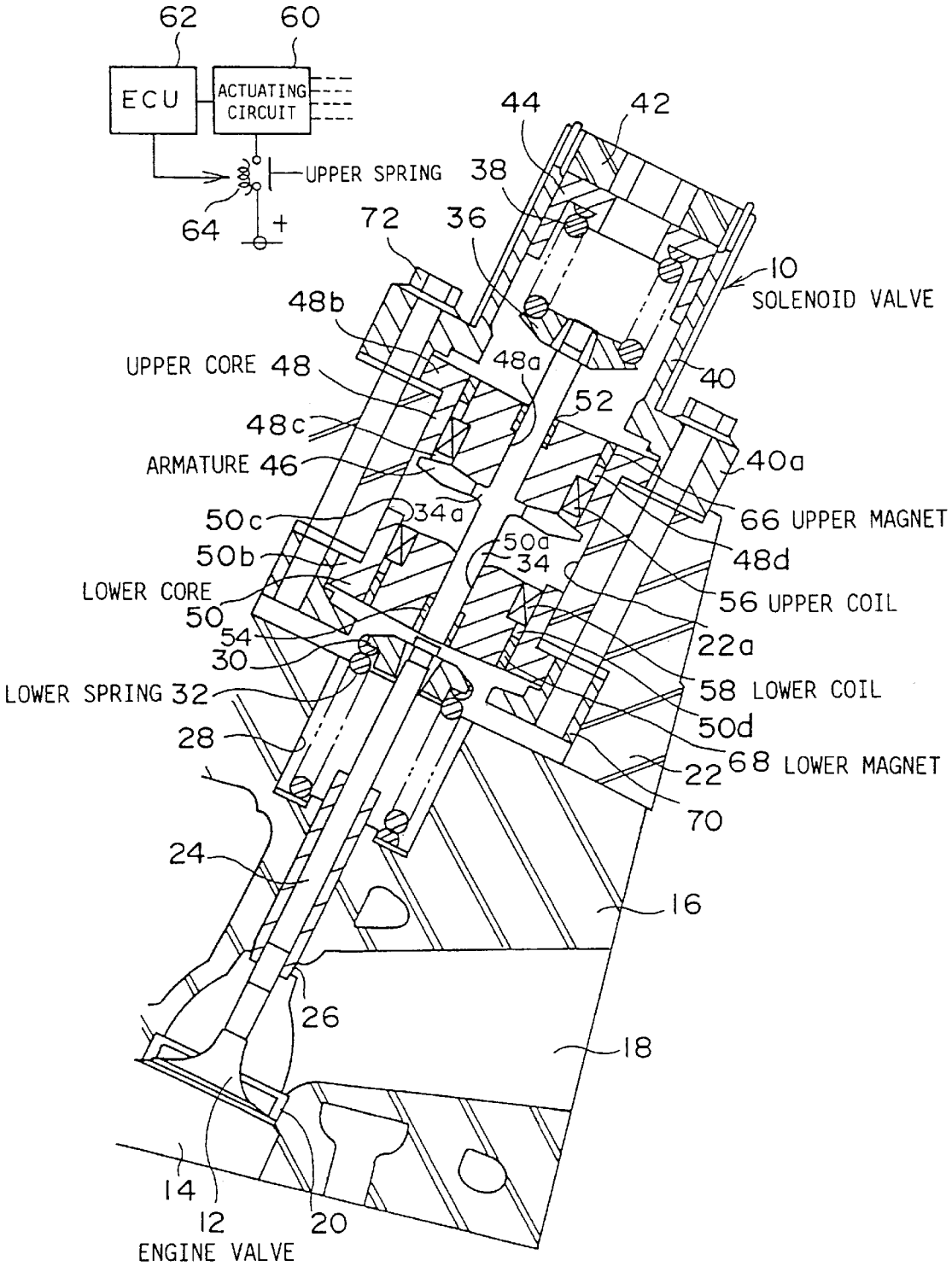
FIG. 1 is a diagram showing a system of an embodiment of the present invention.

FIG. 1 is a diagram showing a system of an embodiment according to the present invention. The system of the present embodiment includes a solenoid valve 10 which is provided to each of intake valves and exhaust valves of an internal combustion engine (hereinafter simply referred to as an engine).

As shown in FIG. 1, the solenoid valve 10 has an engine valve 12 which functions as an intake valve or an exhaust valve. The engine valve 12 is disposed in a lower head 16 so that the engine valve 12 is exposed in a combustion chamber 14 of the engine. A port 18 is formed in the lower head 16. An opening part of the port 18 into the combustion chamber 14 is provided with a valve seat 20 which is associated with the engine valve 12. The port 18 communicates with the combustion chamber 14 when the engine valve 12 is released from the valve seat 20, and the port 18 is disconnected from the combustion chamber 14 when the engine valve 12 is seated on the valve seat 20. An upper head 22 is provided on a top of the lower head 16.

The engine valve 12 has a valve shaft 24 which extends upwardly. The valve shaft 24 is guided by a valve guide 26 so that the valve shaft 24 can move in an axial direction. The valve guide 26 is fixed in the lower head 16. The lower head 16 is provided with a spring containing space 28 which is cylindrically formed and surrounds a substantially upper-half part of the valve shaft 24. A lower retainer 30 is fixed to an upper end part of the valve shaft 24. A lower spring 32 is disposed between the lower retainer 30 and a bottom face of the spring containing space 28. The lower spring 32 exerts a resilient force on the lower retainer 30 so as to push the engine valve 12 in an upward direction, that is, in a valve closing direction.

An armature shaft 34 is disposed coaxially with the valve shaft 24. The armature shaft 34 is made of a non-magnetic material. A lower end face of the armature shaft 34 is in contact with an upper end face of the valve shaft 24. An upper retainer 36 is fixed to an upper end part of the armature shaft 34. A lower end of an upper spring 38 abuts on a top surface of the upper retainer 36. A cylindrical upper cap 40 is provided around the upper spring 38. An adjuster bolt 42 is screwed on a top part of the upper cap 40. An upper end of the upper spring 38 is supported by a spring guide 44 which is interposed between the adjuster bolt 42 and the upper spring 38. The upper spring 38 pushes the armature shaft 34 via the upper retainer 38 in a downward direction. Thus, the upper spring 38 pushes the engine valve 12 in a downward direction, that is, in a valve opening direction.

An armature supporting part 34*a* is formed on an outer circumferential surface of the armature shaft 34 at a substantially center position in an axial direction thereof. The armature supporting part 34*a* projects outwardly in a radial direction of the armature shaft 34. An armature 46 is fixed around the armature supporting part 34*a*. The armature 46 is an annular member which is made of a soft magnetic material.

An upper core 48 is disposed above the armature 46, and a lower core 50 is disposed below the armature 46. Each of the upper core 48 and the lower core 50 is a substantially cylindrical member made of a magnetic material. The upper core 48 and the lower core 50 are provided with through holes 48*a* and 50*a*, respectively, which go though the center parts thereof. An upper bush 52 is disposed in an upper end part of the through hole 48*a*, and a lower bush 54 is disposed in a lower end part of the through hole 50*a*. The armature shaft 34 extends through the through holes 48*a*, 50*a* and is guided by the upper bush 52 and the lower bush 54 so that the armature shaft 34 can move in the axial direction.

The upper core 48 has a flange 48*b* formed at an upper end part thereof. Similarly, the lower core 50 has a flange 50*b* formed at a lower end part thereof. The upper core 48 and the lower core 50 are fitted into a cylindrical part 22*a* which is formed in the upper head 22 so that the flanges 48*b* and 50*b* abut on upper and lower faces of the upper head 22, respectively.

Annular recesses 48*c* and 50*c* are provided to faces of the upper core 48 and the lower core 50, respectively, facing the armature 46. An upper coil 56 and a lower coil 58 are contained in the annular recesses 48*c* and 50*c*, respectively.

The upper coil 56 and the lower coil 58 are electrically connected to an actuating circuit 60. The actuating circuit 60 is supplied with an enable signal for permitting or prohibiting an operation of the solenoid valve 10 and a control signal for controlling the solenoid valve 10 from an electronic control unit (hereinafter referred to as an ECU) 62. The actuating circuit 60 supplies instruction currents to the upper coil 56 and the lower coil 58 in accordance with the control signal supplied from the ECU 62 when the enable signal is in an ON state. Power supply to the actuating circuit 60 can be turned on and off by a power supply relay 64 which is controlled by the ECU 62.

The upper core 48 is provided with an annular slit 48*d* which extends from an upper face of the upper core 48 to an upper face of the annular recess 48*c*. Similarly, the lower core 50 is provided with an annular slit 50*d* which extends from a lower face of the lower core 50 to a bottom face of the annular recess 50*c*. An upper magnet 66 and a lower magnet 68 are contained in the annular slits 48*d* and 50*d*, respectively. Each of the upper magnet 66 and the lower magnet 68 is a permanent magnet having an annular shape which is radially magnetized (so that a radially inner side is an S pole and a radially outer side is an N pole, for example).

The upper cap 40 has a flange 40*a* which is provided at a lower end part thereof. The upper cap 40 is disposed so that the flange part 40*a* covers the flange 48*b* of the upper core 48 from above. A lower cap 70 is disposed on a lower face of the upper head 22 so that the lower cap 70 covers the flange 50*b* of the lower core 50 from below.

The flange 40*a* of the upper cap 40 and the lower cap 70 are fixed to the upper head 22 by fixing bolts 72 so that the upper core 48 and the lower core 50 are fixed inside the upper head 22 with a predetermined spacing being formed therebetween. A neutral position of the armature 46 is adjusted by the above-mentioned adjuster bolt 42 so as to be at a central position between the upper core 48 and the lower core 50.

Next, a description will be given of an operation of the solenoid valve 10.

When the armature 46 is in contact with the upper core 48, magnetic flux generated by the upper magnet 66 goes through the upper core 48 and the armature 46. In this case, a magnetic attracting force is exerted between the armature 46 and the upper core 48. The upper magnet 66 is so constructed that the above-mentioned magnetic attracting force is strong enough to maintain the armature 46 in contact with the upper core 48 against a resilient force of the upper spring 38. Thus, a state in which the armature 46 is in contact with the upper core 48 (that is, a state shown in FIG. 1) can be maintained without energizing the upper coil 56. In this state, the engine valve 12 is seated on the valve seat 20. Hereinafter, a position of the armature 46 or the engine valve 12 in the state where the armature 46 is in contact with the upper core 48 is referred to as a fully closed position of the armature 46 or the engine valve 12.

When the upper coil 56 is supplied with an instruction current which generates magnetic flux in a direction opposite to a direction of the magnetic flux generated by the upper magnet 66 in a state where the armature 46 is held in the fully closed position, the magnetic attracting force exerted between the armature 46 and the upper core 48 becomes smaller than the resilient force of the upper spring 38. Thus, the armature 46 starts moving in a downward direction in FIG. 1 by being pressed by the upper spring 38. When the armature 46 has reached a predetermined position, the lower coil 58 is supplied with an instruction current which generates magnetic flux in the same direction as magnetic flux generated by the lower magnet 68. In this case, an attracting force which attracts the armature 46 toward the lower core 50, that is, an attracting force which actuates the engine valve 12 in a downward direction in FIG. 1, is generated.

When the above attracting force is exerted on the armature 46, the armature 46 downwardly moves with the engine valve 12 against a resilient force of the lower spring 32. In this case, since the magnet flux generated by the lower coil 58 and the magnet flux generated by the lower magnet 68 have the same direction as mentioned above, the attracting force which attracts the armature 46 toward the lower core 50 is increased by an extent corresponding to a magnitude of the magnetic flux generated by the lower magnet 68. The engine valve 12 continues to move until the armature 46 comes into contact with the lower core 50. Hereinafter, a position of the armature 46 or the engine valve 12 in a state where the armature 46 is in contact with the lower core 50 is referred to as a fully opened position of the armature 46 or the engine valve 12.

When the armature 46 has reached the fully opened position, the lower coil 58 is de-energized. In this case, the attracting force generated by the lower coil 58 vanishes and only the magnetic attracting force generated by the lower magnet 68 is exerted between the armature 46 and the lower core 50. The lower magnet 68 is so constructed that this magnetic attracting force is strong enough to maintain the armature 46 in contact with the lower core 50 against the resilient force of the lower spring 32. Thus, the engine valve 12 and the armature 46 are maintained in the fully opened position after the lower coil 58 has been de-energized.

When the lower coil 58 is supplied with an instruction current which generates magnetic flux in a direction opposite to a direction of the magnetic flux generated by the lower magnet 66 in a state where the armature 46 is held in the fully opened position, the attracting force exerted between the armature 46 and the lower core 50 becomes smaller than the resilient force of the lower spring 32. Thus, the armature 46 starts moving in an upward direction in FIG. 1 by being pressed by the lower spring 32. When the armature 46 has reached a predetermined position, the upper coil 56 is supplied with an instruction current which generates magnetic flux in the same direction as the magnetic flux generated by the upper magnet 66. In this case, an attracting force which attracts the armature 46 toward the upper core 48, that is, an attracting force which actuates the engine valve 12 in an upward direction in FIG. 1, is generated.

When the above attracting force is exerted on the armature 46, the armature 46 upwardly moves with the engine valve 12 against the resilient force of the upper spring 38. In this case, since the magnet flux generated by the upper coil 56 and the magnet flux generated by the upper magnet 66 have the same direction as mentioned above, the attracting force which attracts the armature 46 toward the upper core 48 is increased by an extent corresponding to a magnitude of the magnetic flux generated by the upper magnet 66. The engine valve 12 continues to move until the armature 46 comes into contact with the upper core 48, that is, until the armature 46 reaches the fully closed position. The engine valve 12 and the armature 46 can be maintained in the fully closed position after the upper coil 56 is de-energized, as mentioned above.

Hereinafter, the instruction current which is supplied to the upper coil 56 or the lower coil 58 for releasing the armature 46 from the fully closed position or the fully opened position (that is, the instruction current which generates the magnetic flux in a direction which is opposite to the direction of the magnetic flux generated by the upper magnet 66 or the lower magnet 68) is referred to as a release current. Additionally, the current which is supplied to the upper coil 56 or the lower coil 58 for attracting the armature 46 toward the fully closed position or the fully opened position (that is, the instruction current which generates the magnetic flux in the same direction as the magnetic flux generated by the upper magnet 66 or the lower magnet 68) is referred to as an attracting current.

As described above, it is possible to actuate the engine valve 12 between the fully closed position and the fully opened position by supplying the attracting current and the release current to the upper coil 56 and the lower coil 58. Thus, the engine valve 12 can be actuated to be closed and opened in synchronization with a crank angle of the internal combustion engine by the ECU 62 supplying a control signal to the actuating circuit 60 based on the crank angle. In this specification, a control for actuating the engine valve 12 in synchronization with the crank angle is referred to as a regular control.

According to the solenoid valve 10, the armature 46 can be maintained in the fully closed position or the fully opened position by the magnetic attracting force generated by the upper magnet 66 or the lower magnet 68 without a necessity of energizing the upper coil 56 or lower coil 58, as mentioned above. Additionally, since the magnetic attracting force generated by the upper magnet 66 or the lower magnet 68 is exerted on the armature 46 when the armature 46 is actuated toward the fully closed position or the fully opened position, it is possible to reduce the attracting currents required to be supplied to the upper coil 56 and the lower coil 58. Thus, according to the present embodiment, it is possible to effectively lower power consumption of the solenoid valve 10.

When an ignition switch of the engine is not turned on, neither the upper coil 56 nor the lower coil 58 can be energized. In such a situation, if the armature 46 is held in the neutral position between the fully closed position and the fully opened position, that is, if neither the upper magnet 66 nor the lower magnet 68 is provided, it is necessary to actuate the armature 46 to the fully closed position or the fully opened position when the engine is started. As mentioned above, the initial actuation can be used to actuate the armature 46 from the neutral position to the fully closed position or the fully opened position. According to the initial actuation, the upper coil 56 and the lower coil 58 are alternately supplied with currents with a period corresponding to a natural vibration period of a spring-mass system constituted by movable parts including the armature 46, the armature shaft 34 and the valve body 12 and the upper and lower springs 38, 32 so that a natural vibration of the movable parts is excited.

However, a special control program is required to perform the initial actuation in addition to a control program for achieving the regular control. Additionally, during execution of the initial actuation, it is necessary to supply relatively large currents to the upper coil 56 and the lower coil 58, resulting in increased power consumption of the system. Further, during execution of the initial actuation, a relatively large operating sound is generated due to a vibration of the movable parts.

According to the present embodiment, it is possible to achieve a state where the armature 46 and the engine valve 12 are held in the fully closed position when the engine is started without performing the initial actuation.

Figures 2A, 2B, 2C, 2D:
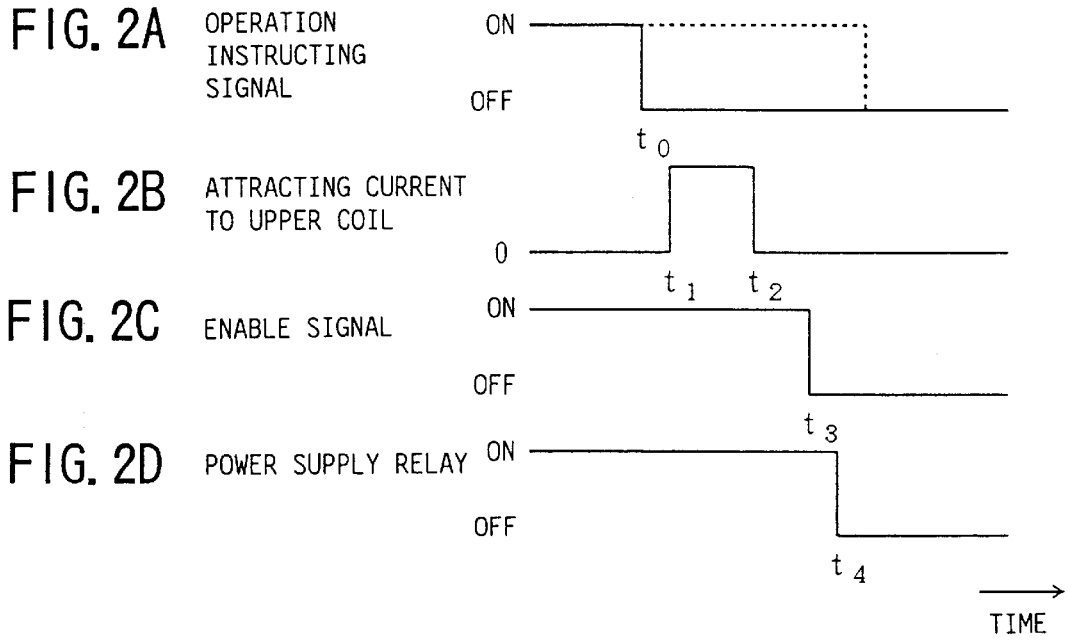
FIG. 2A is a time chart showing an example of an operation instruction current of an internal combustion engine.
FIG. 2B is a time chart showing an example of an attracting current supplied to an upper coil.
FIG. 2C is a time chart showing an example of an enable signal generated by an ECU.
FIG. 2D is a time chart showing an example of a change in an ON/OFF state of a power supply relay.

FIGS. 2A to 2D are time charts of various control signals when a request to stop the engine is generated. FIG. 2A shows an operation instructing signal of the engine, FIG. 2B shows an attracting current supplied to the upper coil 56 of the solenoid valve 10, FIG. 2C shows an enable signal supplied to the actuating circuit 60, and FIG. 2D shows an ON/OFF signal supplied to the power supply relay 64. In FIG. 2A, the operation instructing signal is represented by a solid line and a dotted line for two cases where the request to stop the engine is generated at different timings.

In a case shown by the solid line in FIG. 2A, the operation instructing signal is switched to an OFF state at a time t0 when the request to stop the engine is generated. At this time t0, since the engine valve 12 is not in the fully closed position, the enable signal shown in FIG. 2C is maintained in an ON state. During a time period from tl to t2, the upper coil 56 is supplied with an attracting current as shown in FIG. 2B so that the engine valve 12 is actuated toward the fully closed position. When the engine valve 12 is held in the fully closed position at a time t3, the enable signal is switch to an OFF state as shown in FIG. 2C so that the upper coil 56 and the lower coil 58 are prohibited from being energized. When the enable signals corresponding to all of the solenoid valves 10 provided to the engine are set in an OFF state at a time t4, the power supply relay 64 is switched to an OFF state as shown in FIG. 2D.

If the request to stop the engine is generated at a timing when the engine valve 12 is in the fully closed position (that is, at a timing when supply of the attracting current to the upper coil 56 has been finished) as indicated by the dotted line in FIG. 2A, the enable signal is immediately set in an OFF state.

As mentioned above, in the present embodiment, the engine valve 12 is actuated in accordance with the regular control until the engine valve 12 reaches the fully closed position after the request to stop the engine is generated, and the upper coil 56 and the lower coil 58 are prohibited from being supplied with currents after the engine valve 12 has been held in the fully closed position. The state where the engine valve 12 is held in the fully closed position can be maintained by the magnetic attracting force generated by the upper magnet 66 without supplying a current to the upper coil 56. Thus, when the engine is started next time, the engine valve 12 and the armature 46 are held in the fully closed position. Therefore, according to the present embodiment, it is possible to immediately start the regular control of the engine valve 12 when the engine is started without performing the initial actuation only by supplying the release current to the upper coil 56 at a valve-opening timing of the engine valve 12.

Figure 3:
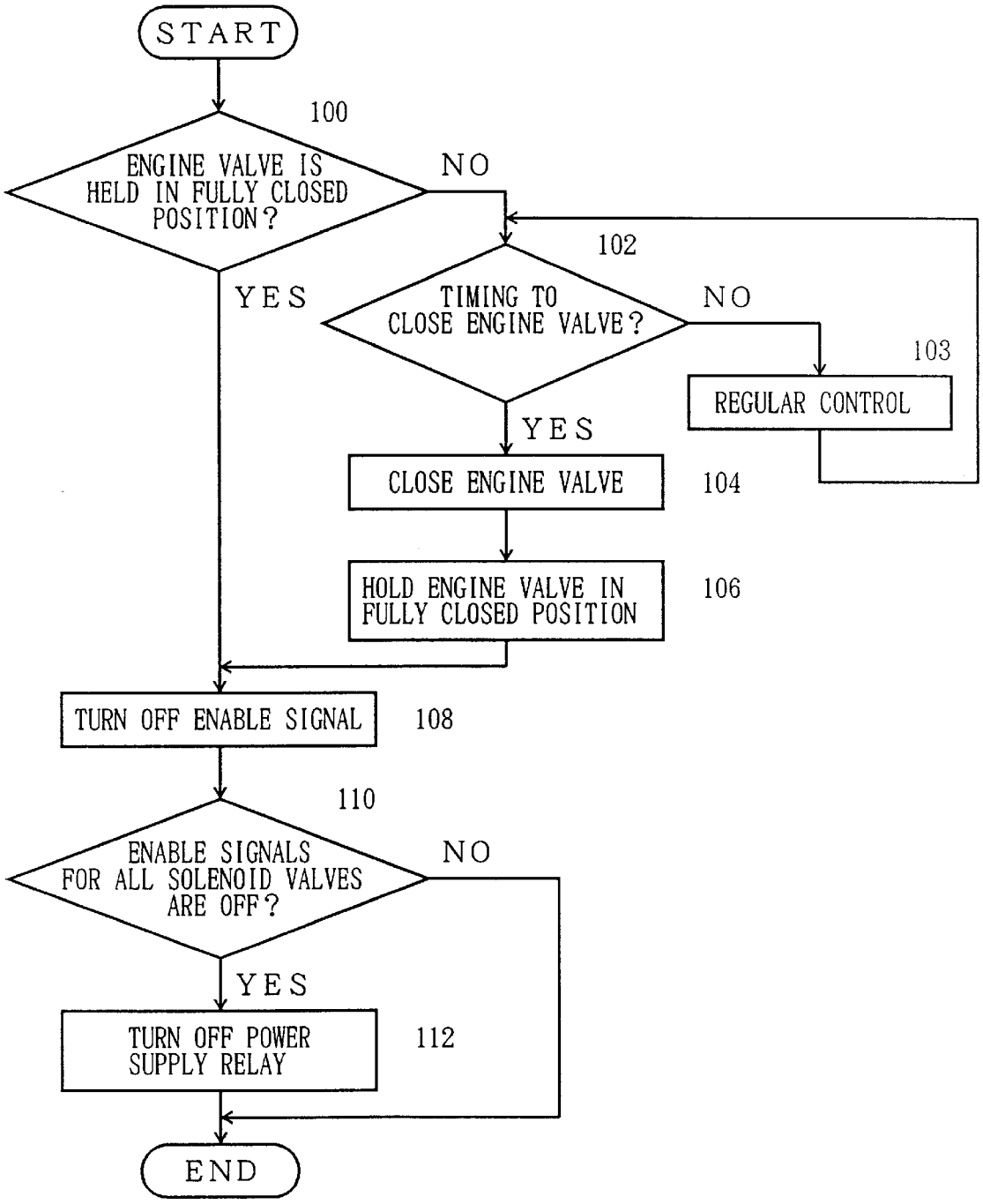
FIG. 3 is a flowchart of a routine performed by the ECU in the present embodiment.

FIG. 3 shows a flowchart of a control routine performed by the ECU 62 so as to achieve the above-mentioned function. The routine shown in FIG. 3 is performed for each solenoid valve 10 at a time when the operation instructing signal of the engine is switched from an ON state to an OFF state. When the routine shown in FIG. 3 is started, the process of step 100 is performed first.

In step 100, it is determined whether or not the engine valve 12 is held in the fully closed position. Such determination can be performed based on a state of the instruction current supplied to the upper coil 56. For example, if supply of the attracting current to the upper coil 56 has been finished but the release current has not yet been supplied to the upper coil 56, it can be determined that the engine valve 12 is held in the fully closed position. It is also possible to provide a sensor for detecting a position of the valve body 12 or the armature shaft 34 and to perform the determination in step 100 based on the detected position of the engine valve 12 or the armature shaft 34. If it is determined that the engine valve 12 is not held in the fully closed position in step 100, then the process of step 102 is performed.

In step 102, it is determined whether or not it is a timing to close the engine valve 12 according to the regular control. If it is not a timing to close the engine valve 12, instruction currents to the upper coil 56 and the lower coil 58 are controlled in accordance with the regular control in step 103, and then the process of step 102 is performed again. On the other hand, if it is a timing to close the engine valve 12 is step 102, then the process of step 104 is performed.

In step 104, the engine valve 102 is closed. Specifically, in step 104, the lower coil 58 is supplied with the release current, and, thereafter, the upper coil 56 is supplied with the attracting current at a predetermined timing.

In step 106, the engine valve 12 is held in the fully closed position. Specifically, in step 106, the instruction current to the upper coil 56 is set to be zero. When the process of step 106 is finished, then the process of step 108 is performed.

If it is determined that the engine valve 12 is held in the fully closed position in the above-mentioned step 100, then the process of step 108 is immediately performed.

In step 108, the enable signal is set in an OFF state.

In step 110, it is determined whether or not the enable signals for all of the solenoid valves 10 provided to the engine are set in an OFF state. If it is affirmatively determined in step 110, the power supply relay 64 is turned off, and then the present routine is ended. On the other hand, if it is negatively determined in step 110, then the process of step 112 is skipped and the present routine is ended.

If the system of the present embodiment is constructed so that power supply to a plurality of actuating circuits 60 is controlled by a common power supply relay 64, this power supply relay 64 may be turned off when the enable signals for all of the solenoid valves 10 corresponding to the power supply relay 64 are set in an OFF state in the above-mentioned steps 110 and 112.

As mentioned above, it is possible to hold the armature 46 in the fully closed position without performing the initial actuation when the engine is started. Thus, according to the present embodiment, special control means such as a control program for performing the initial actuation can be avoided. Additionally, since the initial actuation need not be performed, it is possible to lower power consumption and reduce an operating sound of the solenoid valve 10 when the engine is started. Further, the regular control can be immediately started when the engine is started. Still further, since the armature 46 is held in the fully closed position by the magnetic attracting force of the upper magnet 66, it is possible to prevent the solenoid valve 10 from consuming electric power while the engine is not operating.

In the above-mentioned embodiment, the armature 46 is held in the fully closed position when the engine is stopped. However, the armature 46 may be held in the fully opened position. For example, it is possible that all of the armatures 46 provided to the engine are held in the fully opened position. It is also possible that the armatures 46 corresponding to the intake valves are held in the fully closed position (or the fully opened position) and the armatures 46 corresponding to the exhaust valves are held in the fully opened position (or the fully closed position).

Additionally, in the above-mentioned embodiment, both the upper core 48 and the lower core 50 are provided with permanent magnets (namely, the upper magnet 66 and the lower magnet 68). However, it is also possible to provide a permanent magnet to only one of the upper core 48 and the lower core 50 in accordance with a position in which the armature 46 is held when the engine is stopped. That is, if the armature 46 is held in the fully closed position, at least the upper core 48 is provided with a permanent magnet, and if the armature 46 is held in the fully opened position, at least the lower core 50 is provided with a permanent magnet.

Further, by holding the armature 46 in the fully closed position or the fully opened position when the engine is shipped, it is possible to smoothly start operating the solenoid valve 10 when the engine is operated for the first time after the shipment.

Additionally, in the above-mentioned embodiment, the engine valve 12 is closed at a timing in accordance with the regular control after the request to stop the engine is generated. However, it is also possible to forcibly close the engine valve 12 irrespective of the valve-closing timing of the regular control after the request to stop the engine is generated.

The present invention is not limited to these embodiments, but variations and modifications may be made without departing from the scope of the present invention.

The present application is based on Japanese priority application No. 10-329931 filed on Nov. 19, 1998, the entire contents of which are hereby incorporated for reference.

What is claimed is:

1. An electromagnetic actuating system of an internal combustion engine, comprising:

an engine valve which functions as an intake valve or an exhaust valve of the internal combustion engine;

an armature which moves with said engine valve;

an electromagnet which attracts said armature in a direction of movement of said engine valve by being supplied with a current;

a spring which presses said armature away from said electromagnet;

a permanent magnet which can exert a magnetic attracting force between said armature and said electromagnet; and a stop-time current controller which shuts off the current supplied to said electromagnet, after controlling the current supplied to said electromagnet until said armature is attracted to said electromagnet by the magnetic attracting force of said permanent magnet, when a request to stop the internal combustion engine is generated.

2. The electromagnetic actuating system of an internal combustion engine as claimed in claim 1, wherein said stop-time current controller controls the current supplied to said electromagnet in accordance with a regular control of said engine valve until the armature is attracted to said electromagnet by the magnetic attracting force of said permanent magnet.

3. The electromagnetic actuating system of an internal combustion engine as claimed in claim 1, wherein said stop-time current controller immediately shuts off the current supplied to said electromagnet if the armature is attracted to said electromagnet when the request to stop the internal combustion engine is generated.

4. The electromagnetic actuating system of an internal combustion engine as claimed in claim 1, further comprising a power supply controller which shuts off power supply to said electromagnetic actuating system after said armature is attracted to said electromagnet by the magnetic attracting force of said permanent magnet after the request to stop the internal combustion engine is generated.

5. The electromagnetic actuating system of an internal combustion engine as claimed in claim 1, wherein said permanent magnet generates magnetic flux in the same direction as magnetic flux generated by said electromagnet to attract said armature.

6. The electromagnetic actuating system of an internal combustion engine as claimed in claim 1, wherein said permanent magnet is supported by a core of said electromagnet.

7. An electromagnetic actuating system of an internal combustion engine, comprising:

an engine valve which function as an intake valve or an exhaust valve of the internal combustion engine;

an armature which moves with said engine valve;

a pair of electromagnets which attract said armature in a valve-opening direction and a valve-closing direction, respectively;

a spring which presses said armature toward a neutral position between said electromagnets;

a permanent magnet which can exert a magnetic attracting force between said armature and at least one of said electromagnets; and a stop-time current controller which shuts off currents supplied to said electromagnets, after controlling currents supplied to said electromagnets until said armature is attracted by the magnetic attracting force of said permanent magnet to one of said electromagnets corresponding to said permanent magnet, when a request to stop the internal combustion engine is generated.

8. The electromagnetic actuating system of an internal combustion engine as claimed in claim 7, wherein said stop-time current controller controls the currents supplied to said electromagnets in accordance with a regular control of said engine valve until the armature is attracted by the magnetic attracting force of said permanent magnet to said one of the electromagnets.

9. The electromagnetic actuating system of an internal combustion engine as claimed in claim 7, wherein said stop-time current controller immediately shuts off the current supplied to said electromagnets if the armature is attracted to said one of the electromagnets when the request to stop the internal combustion engine is generated.

10. The electromagnetic actuating system of an internal combustion engine as claimed in claim 7, further comprising a power supply controller which shuts off power supply to said electromagnetic actuating system after said armature is attracted by the magnetic attracting force of said permanent magnet to said one of the electromagnets after the request to stop the internal combustion engine is generated.

11. The electromagnetic actuating system of an internal combustion engine as claimed in claim 7, wherein said permanent magnet generates magnetic flux in the same direction as magnetic flux generated by said corresponding one of said electromagnets to attract said armature.

12. The electromagnetic actuating system of an internal combustion engine as claimed in claim 7, wherein said permanent magnet is supported by a core of said at least one of the electromagnets.

* * * * *